US007540315B2

(12) United States Patent
Chen

(10) Patent No.: US 7,540,315 B2
(45) Date of Patent: Jun. 2, 2009

(54) WINDING MECHANISM FOR A WINDOW BLIND

(76) Inventor: Kuo-Hua Chen, 65, Songzhu N. Rd., Beitun Dirtrice, Taichung City (TW)

( * ) Notice: Subject to any disclaimer, the term of this patent is extended or adjusted under 35 U.S.C. 154(b) by 219 days.

(21) Appl. No.: 11/590,414

(22) Filed: Oct. 31, 2006

(65) Prior Publication Data

US 2007/0102554 A1 May 10, 2007

(30) Foreign Application Priority Data

Nov. 10, 2005 (TW) ..... 94219475 U

(51) Int. Cl.
*E06B 9/30* (2006.01)

(52) U.S. Cl. ..... 160/171; 160/172 R; 160/344; 242/395; 242/397.3; 242/407

(58) Field of Classification Search ..... 160/171, 160/170, 168.1 R, 173 R, 178.1 R; 242/389, 242/395, 397.3, 407, 483
See application file for complete search history.

(56) References Cited

U.S. PATENT DOCUMENTS

| | | | | |
|---|---|---|---|---|
| 5,070,927 | A * | 12/1991 | Chen | 160/344 |
| 5,645,118 | A * | 7/1997 | Lagarde | 160/170 |
| 6,158,494 | A * | 12/2000 | Huang | 160/84.05 |
| 6,289,964 | B1 * | 9/2001 | Colson et al. | 160/121.1 |
| 6,435,252 | B2 * | 8/2002 | Colson et al. | 160/121.1 |
| 6,662,850 | B2 * | 12/2003 | Chung et al. | 160/171 |
| 6,782,938 | B2 * | 8/2004 | Colson et al. | 160/121.1 |
| 6,910,516 | B2 * | 6/2005 | Huang | 160/170 |
| 6,918,424 | B2 * | 7/2005 | Lin | 160/171 |
| 6,935,398 | B2 * | 8/2005 | Koot et al. | 160/84.06 |
| 7,096,918 | B2 * | 8/2006 | Lin | 160/171 |
| 7,287,569 | B2 * | 10/2007 | Lin | 160/170 |
| 7,370,683 | B2 * | 5/2008 | Numajiri | 160/170 |
| 2005/0109472 | A1 * | 5/2005 | Lin | 160/171 |
| 2006/0037720 | A1 * | 2/2006 | Huang | 160/171 |
| 2006/0070706 | A1 * | 4/2006 | Lin | 160/171 |
| 2006/0249264 | A1 * | 11/2006 | Lin | 160/171 |
| 2007/0144686 | A1 * | 6/2007 | Drew | 160/170 |

* cited by examiner

*Primary Examiner*—Blair M. Johnson
*Assistant Examiner*—Jaime F Cardenas-Garcia
(74) *Attorney, Agent, or Firm*—Alan Kamrath; Kamrath & Associates PA

(57) ABSTRACT

A winding mechanism for a window blind includes a base having two slideways, a rotation member rotatably mounted on the base and having an outer wall formed with a threaded guide portion, and a guide seat having an inner wall formed with a threaded guide hole screwed onto the threaded guide portion of the rotation member and an outer wall formed with two guide posts each provided with a roller slidably mounted in a respective slideway of the base. Thus, when the lift cord is wound around the rotation member, the guide seat is movable successively on the rotation member by guidance of the roller, so that the lift cord is wound around the rotation member serially and smoothly by guidance of the guide seat, thereby preventing the lift cord from being tangled.

20 Claims, 9 Drawing Sheets

WINDING MECHANISM FOR A WINDOW BLIND

BACKGROUND OF THE INVENTION

1. Field of the Invention

The present invention relates to a winding mechanism and, more particularly, to a winding mechanism for a window blind.

2. Description of the Related Art

A conventional winding mechanism for a window blind in accordance with the prior art shown in FIGS. 8-10 comprises a base 10 having a hollow inside formed with a receiving chamber 101 and having two opposite end walls each formed with an opening 102 and a locking hole 103, a threaded rod 11 rotatably mounted on the base 10 and having an inside formed with a square drive hole 111, a square drive shaft extended through the drive hole 111 of the threaded rod 11 to rotate the threaded rod 11, a guide disk 12 having an inner wall formed with a threaded guide hole 121 screwed onto the threaded rod 11 and a peripheral wall formed with a limit hole 122, and a limit rod 14 extended through the limit hole 122 of the guide disk 12 and having two ends each secured in the respective locking hole 103 of the base 10. The base 10 has a bottom wall formed with a cord passage 104. The threaded rod 11 has two ends supported by the openings 102 of the base 10. The threaded rod 11 has a side formed with an annular flange 112 having a fixing hole 113. The guide disk 12 has an outer wall formed with a guide groove 123. A lift cord 20 has a first end secured in the fixing hole 113 of the threaded rod 11 to rotate with the threaded rod 11 and a second end extended through the guide groove 123 of the guide disk 12 and the cord passage 104 of the base 10 and protruded outwardly from the base 10 to connect a plurality of slats (not shown).

In operation, when the drive shaft 13 is rotated, the threaded rod 11 is rotated relative to the base 10 to wind or unwind the lift cord 20. At this time, the guide disk 12 is limited by the limit rod 14 so that the guide disk 12 is axially movable on the threaded rod 11 by guidance of the limit rod 14 and is not rotatable with the threaded rod 11 when the threaded rod 11 is rotatable relative to the base 10. Thus, when the threaded rod 11 is rotatable relative to the base 10, the guide disk 12 is axially movable on the threaded rod 11 as shown in FIGS. 9 and 10, so that when the lift cord 20 is wound around the threaded rod 11, the guide disk 12 is movable on the threaded rod 11, and the lift cord 20 is wound around the threaded rod 11 by guidance of the guide disk 12.

However, the limit rod 14 provides a resistance to the guide disk 12 during the axial movement of the guide disk 12, so that the guide disk 12 is not moved easily and smoothly, thereby affecting the winding and unwinding action of the lift cord 20. In addition, when the guide disk 12 is movable to the outermost portion the threaded rod 11, the guide disk 12 is easily jammed due to an excessive force applied on the guide disk 12, thereby affecting or failing operation of the winding mechanism.

BRIEF SUMMARY OF THE INVENTION

In accordance with the present invention, there is provided a winding mechanism, comprising a base having a bottom plate formed with two axially extending slideways, a rotation member rotatably mounted on the base and having an outer wall formed with an axially extending threaded guide portion, and a guide seat having an inner wall formed with a threaded guide hole screwed onto the threaded guide portion of the rotation member and an outer wall formed with two protruding guide posts each provided with at least one roller slidably mounted in a respective slideway of the base so that the guide seat is axially movable on the rotation member by guidance of the guide posts when the rotation member is rotatable relative to the base.

The primary objective of the present invention is to provide a winding mechanism that is operated easily and smoothly.

Another objective of the present invention is to provide a winding mechanism for a window blind, wherein when the lift cord is wound around the rotation member, the guide seat is movable successively on the rotation member by guidance of the roller, so that the lift cord is wound around the rotation member serially and smoothly by guidance of the guide seat, thereby preventing the lift cord from being tangled.

A further objective of the present invention is to provide a winding mechanism for a window blind, wherein the lift cord is extended through and guided by the guide groove of the roller, so that the lift cord is moved smoothly, and the guide seat is also moved smoothly.

A further objective of the present invention is to provide a winding mechanism for a window blind, wherein when the guide seat is movable to the outermost portion the rotation member, a further movement of the guide seat is stopped by the first end cap and the second end cap respectively, thereby preventing the guide seat from being jammed due to an excessive force applied on the guide seat.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
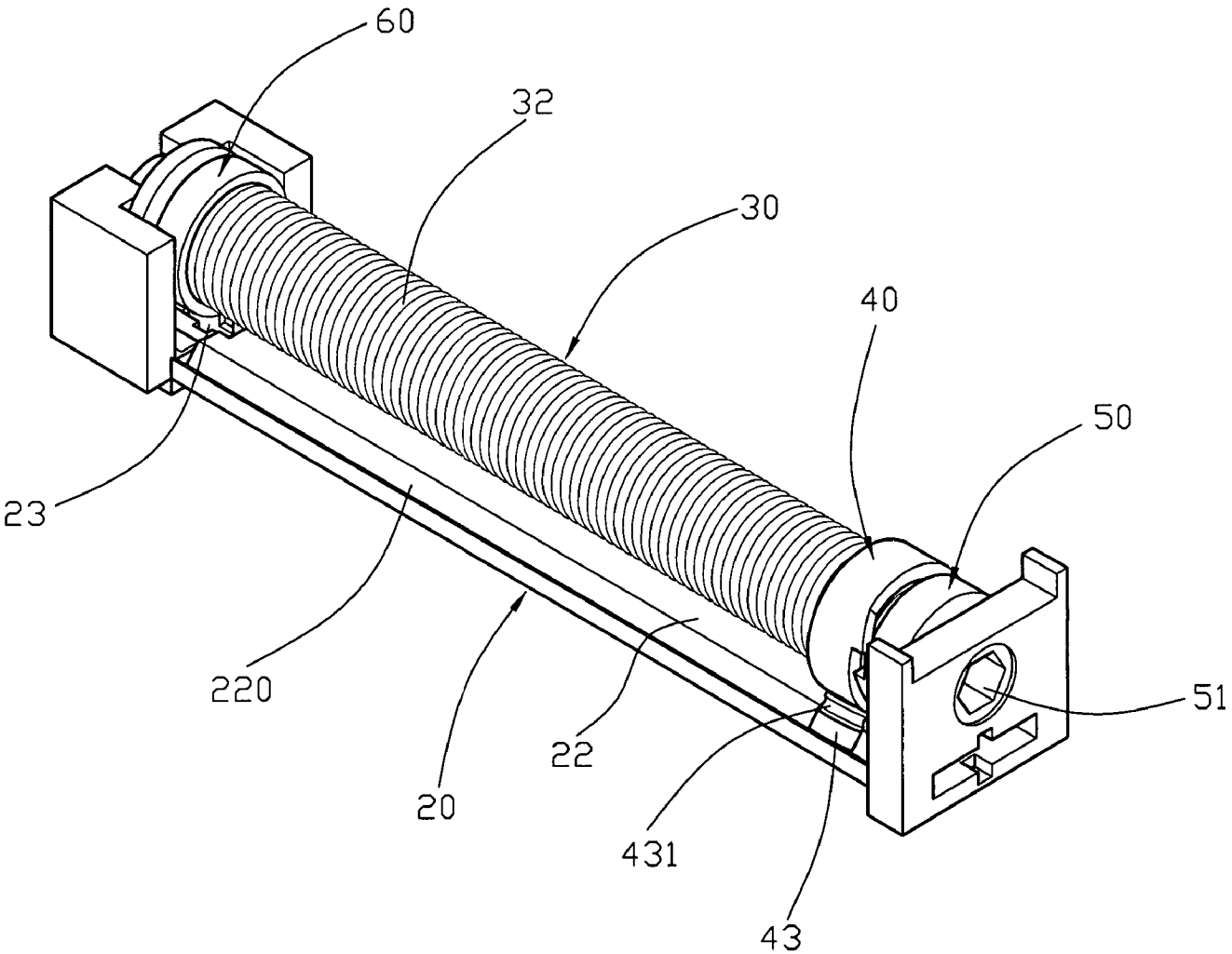
FIG. 1 is a perspective view of a winding mechanism in accordance with the preferred embodiment of the present invention.
Figure 2:
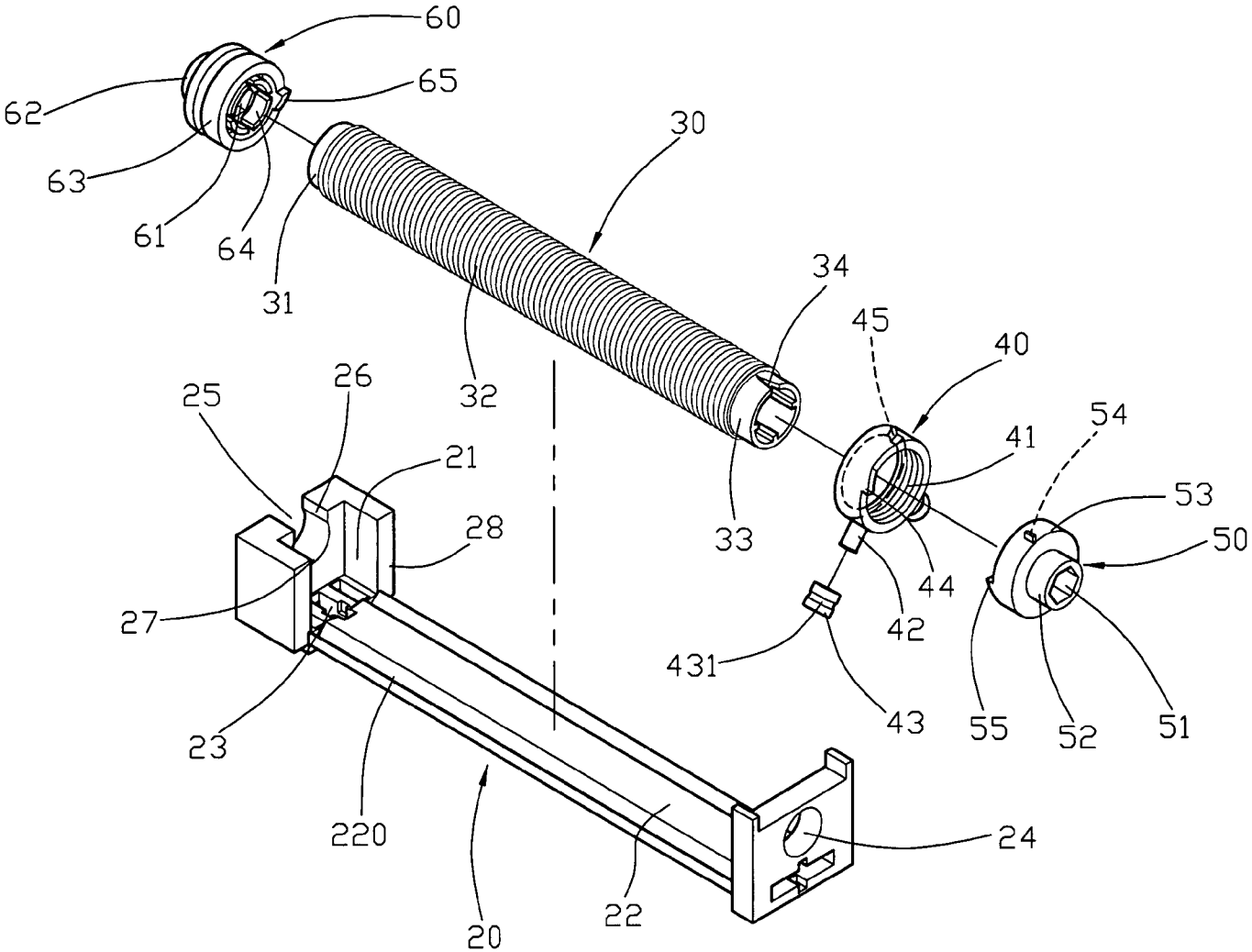
FIG. 2 is an exploded perspective view of the winding mechanism as shown in FIG. 1.
Figure 3:
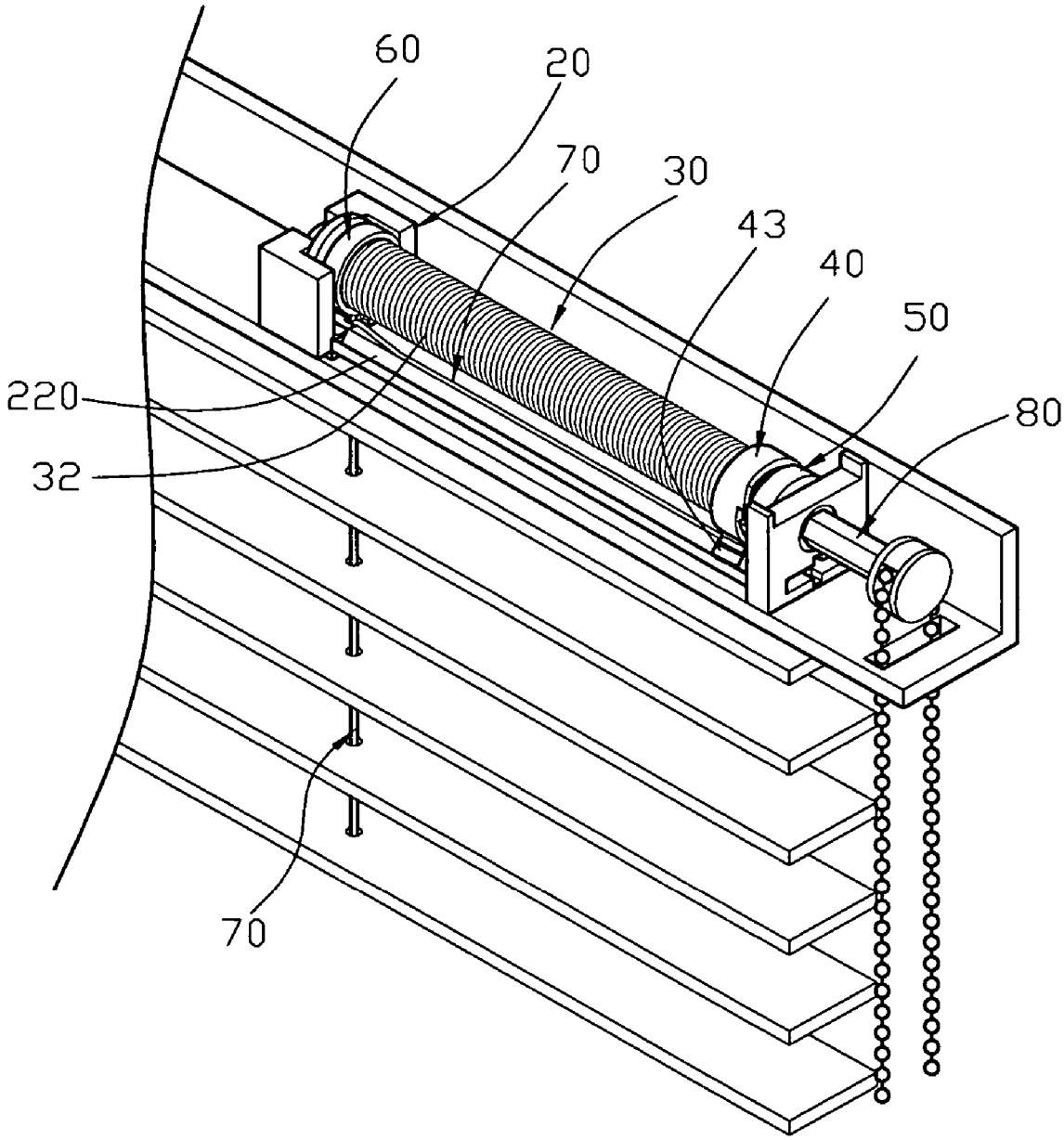
FIG. 3 is a perspective view of the winding mechanism for a window blind as shown in FIG. 1.

Referring to the drawings and initially to FIGS. 1-5, a winding mechanism for a window blind in accordance with the preferred embodiment of the present invention comprises a base 20 having a bottom plate 22 formed with two axially extending slideways 220, a rotation member 30 rotatably mounted on the base 20 and having an outer wall formed with an axially extending threaded guide portion 32, a guide seat 40 having an inner wall formed with a threaded guide hole 41 screwed onto the threaded guide portion 32 of the rotation member 30 and an outer wall formed with two protruding guide posts 42 each provided with at least one roller 43 slidably mounted in a respective slideway 220 of the base 20 so that the guide seat 40 is axially movable on the rotation member 30 by guidance of the guide posts 42 and is not rotatable with the rotation member 30 when the rotation member 30 is rotatable relative to the base 20, a first end cap 50 secured to a first end 33 of the rotation member 30 and rotatably mounted on a first end of the base 20, and a second end cap 60 secured to a second end 31 of the rotation member 30 and rotatably mounted on a second end of the base 20 so that the guide seat 40 is movable between the first end cap 50 and the second end cap 60.

The base 20 has a hollow inside formed with a receiving chamber 21 connected to the slideways 220 to receive the rotation member 30, the guide seat 40, the first end cap 50 and the second end cap 60 and has two axially extending opened sidewalls 28 each connected to the receiving chamber 21. The bottom plate 22 of the base 20 has an end formed with a cord passage 23 located in the second end of the base 20 and connected to the receiving chamber 21 to allow passage of a lift cord 70. The first end of the base 20 has a wall formed with an insertion hole 24. The second end of the base 20 has a wall formed with a recess 25. The recess 25 of the base 20 has an opened upper portion formed with two inwardly extending flexible limit edges 26 and a lower portion formed with a substantially arc-shaped support portion 27.

The rotation member 30 has a tubular shape. The first end 33 of the rotation member 30 has a peripheral wall formed with an axially extending slit 34 to secure the lift cord 70.

The guide seat 40 has a ring shape and has a first side formed with a protruding first catch portion 44 having a serrated shape and directed toward the first end cap 50 and a second side formed with a protruding second catch portion 45 having a serrated shape and directed toward the second end cap 60. The roller 43 of each of the guide posts 42 of the guide seat 40 has a middle portion formed with an arcuate guide groove 431 to receive and guide the lift cord 70 and a distal end slidable in the respective slideway 220 of the base 20.

The first end cap 50 has an inside formed with a polygonal drive hole 51 and has a first end formed with a mounting portion 52 inserted into and rotatably mounted in the insertion hole 24 of the base 20 and a second end formed with an enlarged resting portion 53 mounted on the first end 33 of the rotation member 30. The resting portion 53 of the first end cap 50 has a side formed with a protruding locking portion 55 having a serrated shape and directed toward the guide seat 40. The resting portion 53 of the first end cap 50 has an inner wall formed with a positioning block 54 inserted into the slit 34 of the rotation member 30 and rested on the lift cord 70 to secure the lift cord 70 in the slit 34 of the rotation member 30.

The second end cap 60 has an inside formed with a polygonal drive bore 61 and has a first end formed with a mounting portion 62 snapped into and rotatably mounted in the recess 25 of the base 20 and a second end formed with an enlarged resting portion 63 mounted on the second end 31 of the rotation member 30. The resting portion 63 of the second end cap 60 has a side formed with a protruding locking portion 65 having a serrated shape and directed toward the guide seat 40. The resting portion 63 of the second end cap 60 has an inner wall provided with a plurality of elastic pressing plates 64 rested in the second end 31 of the rotation member 30. The mounting portion 62 of the second end cap 60 is supported by the support portion 27 of the base 20 and limited by the limit edges 26 of the base 20 to prevent the second end cap 60 from being moved upwardly to detach from the recess 25 of the base 20.

The lift cord 70 has a first end secured in the slit 34 of the rotation member 30 to rotate with the rotation member 30 and a second end extended through and guided by the guide groove 431 of the roller 43 of one of the guide posts 42 of the guide seat 40 and the cord passage 23 of the base 20 and protruded outwardly from the base 20 to connect a plurality of slats 72.

The winding mechanism further comprises a drive shaft 80 having a polygonal shape and extended through the drive hole 51 of the first end cap 50, the rotation member 30 and the drive bore 61 of the second end cap 60 so that the first end cap 50, the rotation member 30 and the second end cap 60 are rotated simultaneously by the drive shaft 80.

Figure 4:
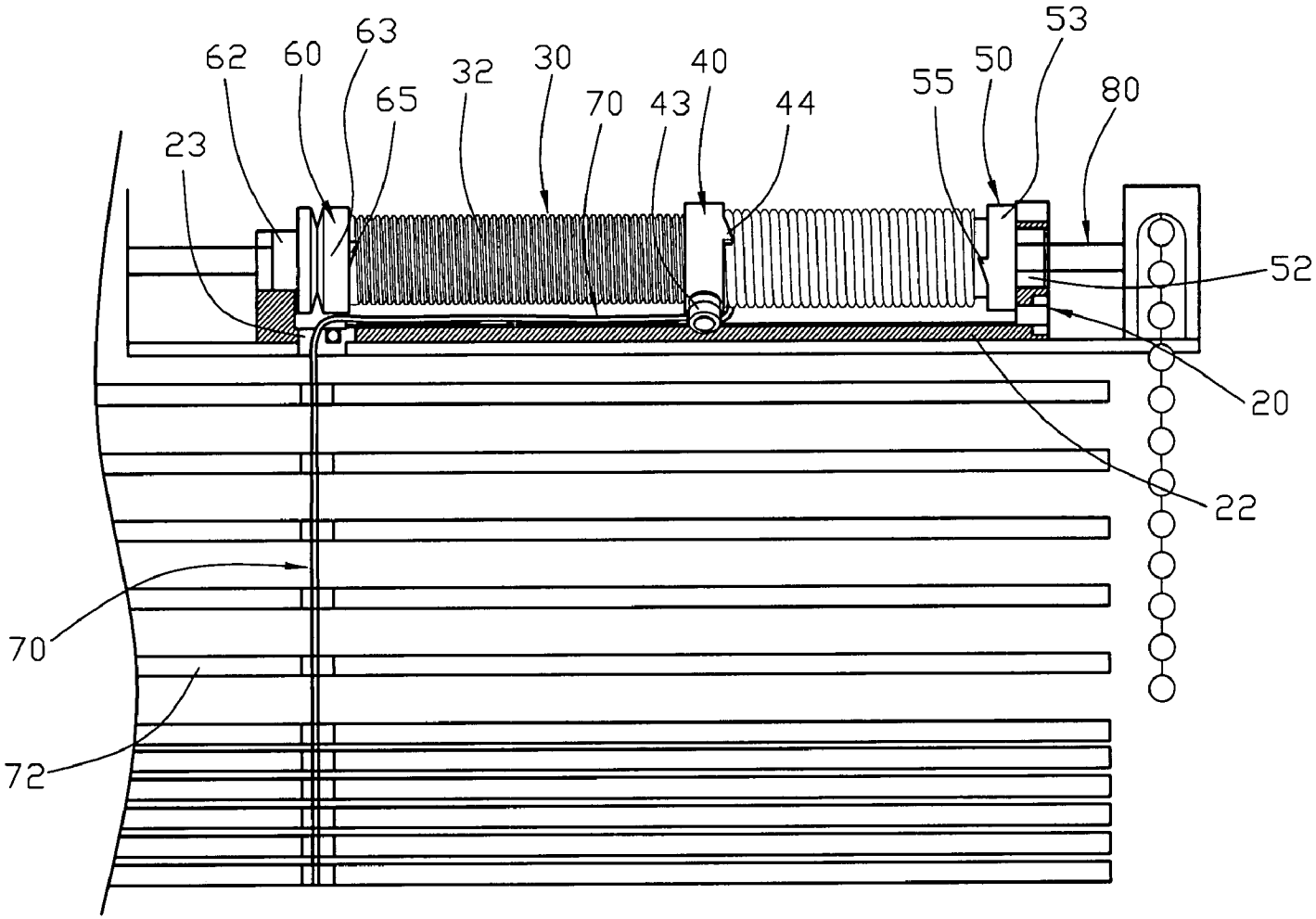
FIG. 4 is a partially plan cross-sectional view of the winding mechanism as shown in FIG. 3.
Figure 5:
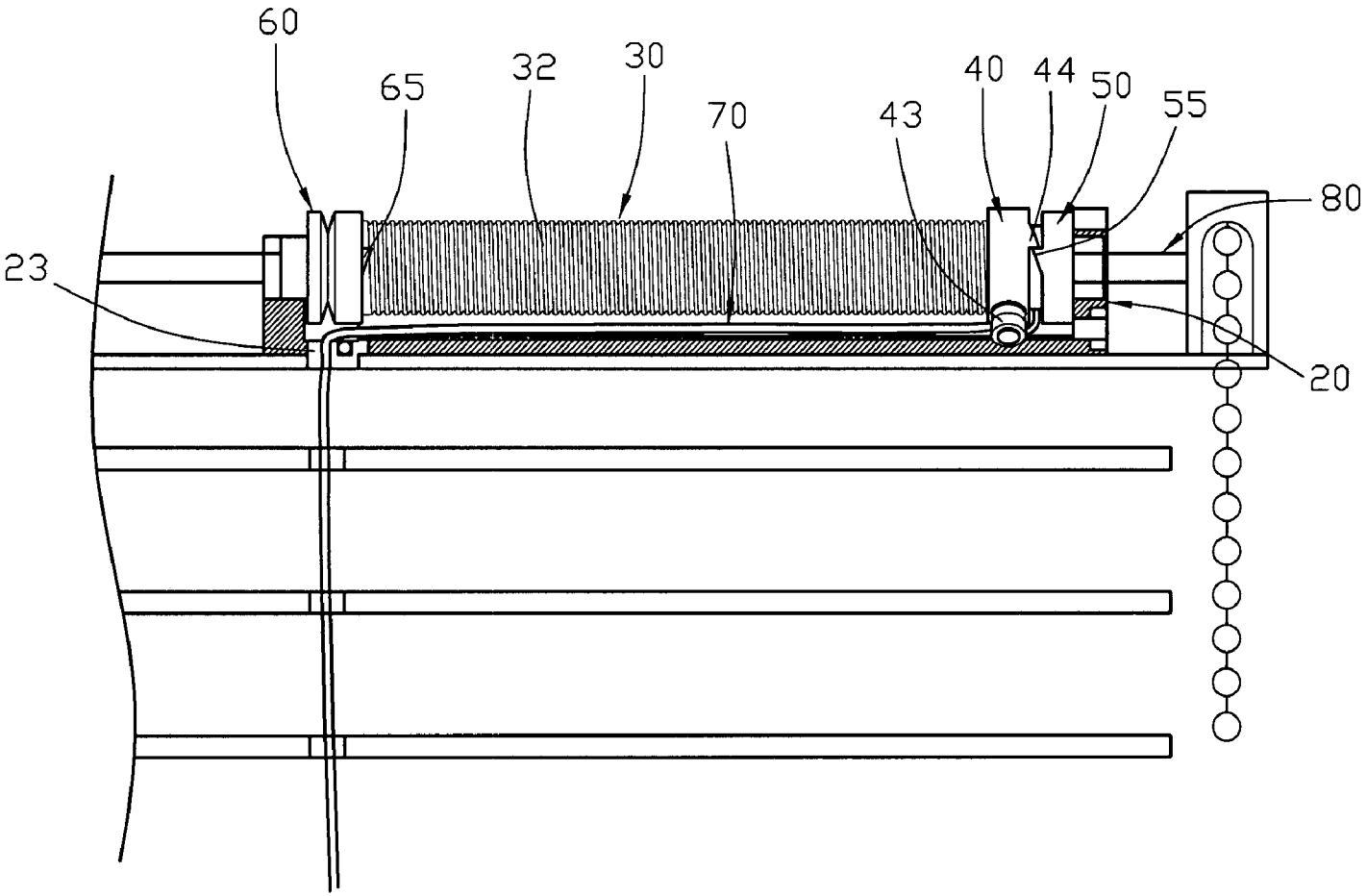
FIG. 5 is a schematic operational view of the winding mechanism as shown in FIG. 4.

In operation, when the drive shaft 80 is rotated, the rotation member 30 is rotated relative to the base 20 to wind or unwind the lift cord 70. At this time, the guide hole 41 of the guide seat 40 is screwed onto the threaded guide portion 32 of the rotation member 30, and the roller 43 of each of the guide posts 42 of the guide seat 40 is limited by the respective slideway 220 of the base 20, so that the guide seat 40 is axially movable on the rotation member 30 by guidance of the guide posts 42 and is not rotatable with the rotation member 30 when the rotation member 30 is rotatable relative to the base 20. Thus, when the rotation member 30 is rotatable relative to the base 20, the guide seat 40 is axially movable on the rotation member 30 as shown in FIGS. 4 and 5, so that when the lift cord 70 is wound around the rotation member 30 by rotation of the rotation member 30, the guide seat 40 is movable on the rotation member 30 successively, and the lift cord 70 is wound around the rotation member 30 serially and smoothly by guidance of the guide seat 40, thereby preventing the lift cord 70 from being tangled. In addition, the lift cord 70 is extended through and guided by the guide groove 431 of the roller 43 of one of the guide posts 42 of the guide seat 40, so that the lift cord 70 is moved smoothly, and the guide seat 40 is also moved smoothly.

As shown in FIG. 5, when the guide seat 40 is movable to rest on the first end cap 50, the first catch portion 44 of the guide seat 40 is stopped by the locking portion 55 of the first end cap 50 to stop a further movement of the guide seat 40, thereby preventing the guide seat 40 from being jammed due to an excessive force applied on the guide seat 40.

Alternatively, when the guide seat 40 is movable to rest on the second end cap 60, the second catch portion 45 of the guide seat 40 is stopped by the locking portion 65 of the second end cap 60 to stop a further movement of the guide seat 40, thereby preventing the guide seat 40 from being jammed due to an excessive force applied on the guide seat 40.

Accordingly, when the lift cord 70 is wound around the rotation member 30, the guide seat 40 is movable successively on the rotation member 30 by guidance of the roller 43, so that the lift cord 70 is wound around the rotation member 30 serially and smoothly by guidance of the guide seat 40, thereby preventing the lift cord 70 from being tangled. In addition, the lift cord 70 is extended through and guided by the guide groove 431 of the roller 43, so that the lift cord 70 is moved smoothly, and the guide seat 40 is also moved smoothly. Further, when the guide seat 40 is movable to the outermost portion the rotation member 30, a further movement of the guide seat 40 is stopped by the first end cap 50 and the second end cap 60 respectively, thereby preventing the guide seat 40 from being jammed due to an excessive force applied on the guide seat 40.

Figure 6:
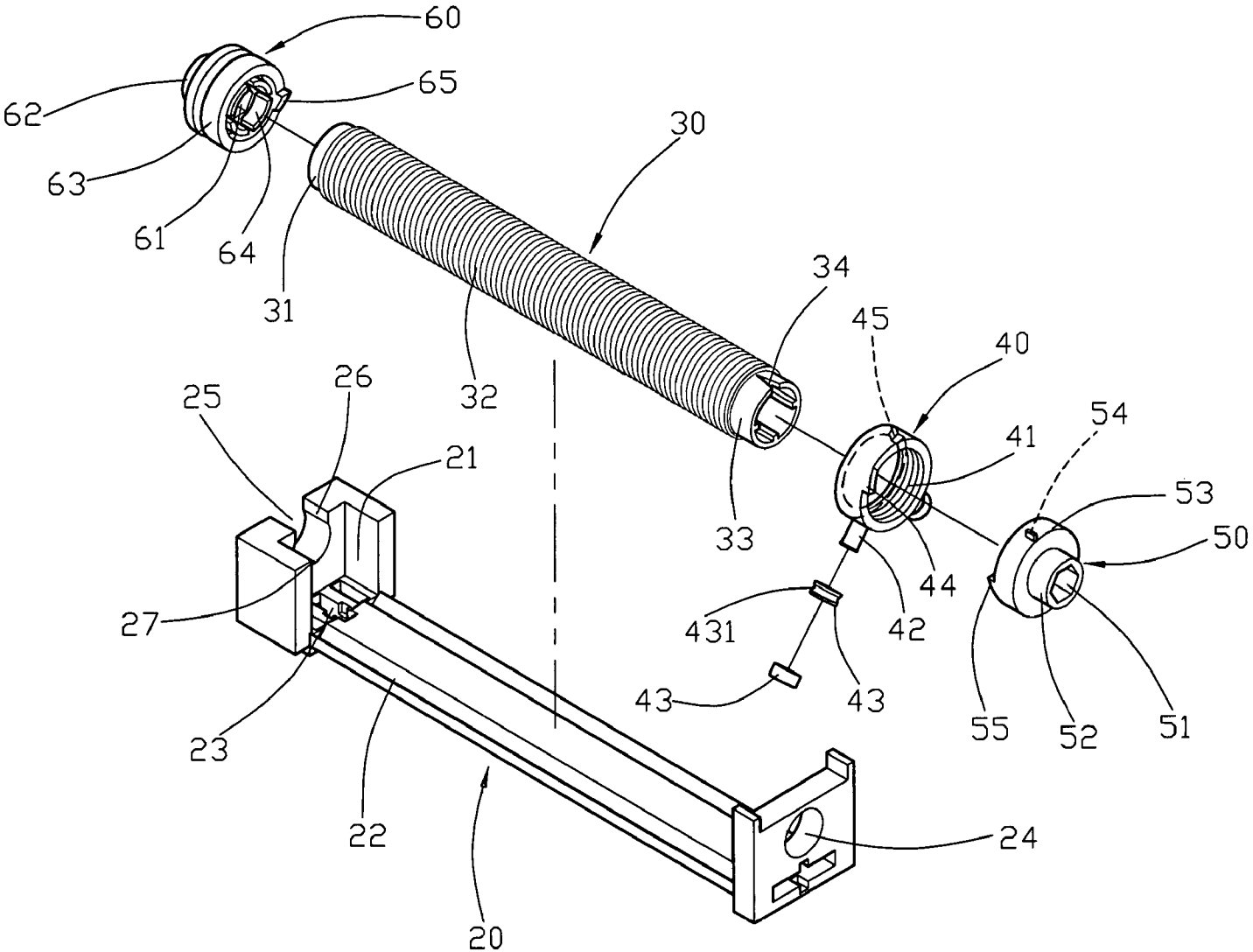
FIG. 6 is an exploded perspective view of a winding mechanism in accordance with another preferred embodiment of the present invention.

As shown in FIG. 6, each of the guide posts 42 of the guide seat 40 is provided with two juxtaposed rollers 43, wherein a lower one of the rollers 43 of each of the guide posts 42 is slidable in the respective slideway 220 of the base 20, and an upper one of the rollers 43 of each of the guide posts 42 has a middle portion formed with an arcuate guide groove 431 to receive and guide the lift cord 70.

Figure 7:
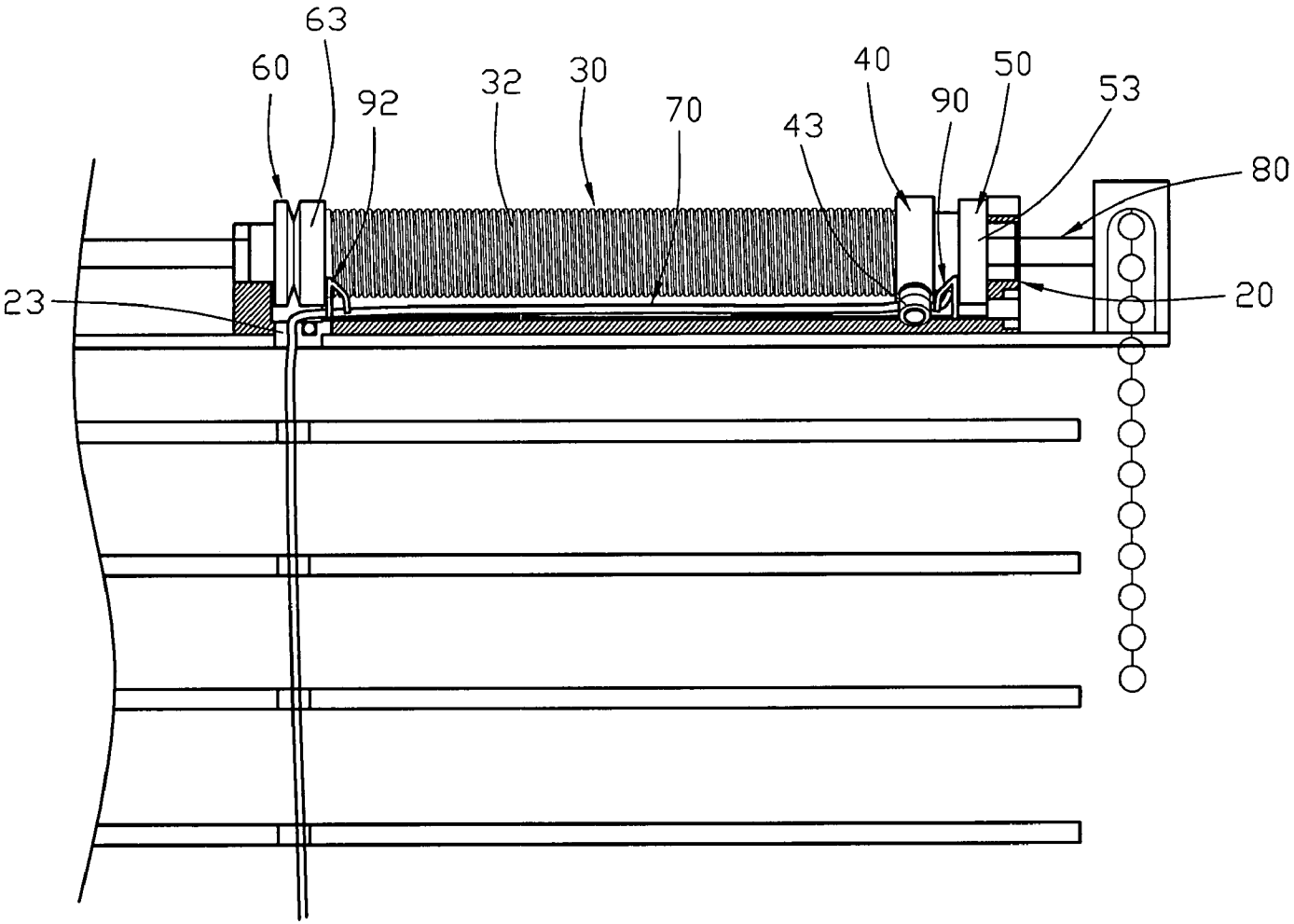
FIG. 7 is a partially plan cross-sectional view of a winding mechanism in accordance with another preferred embodiment of the present invention.
Figure 8:
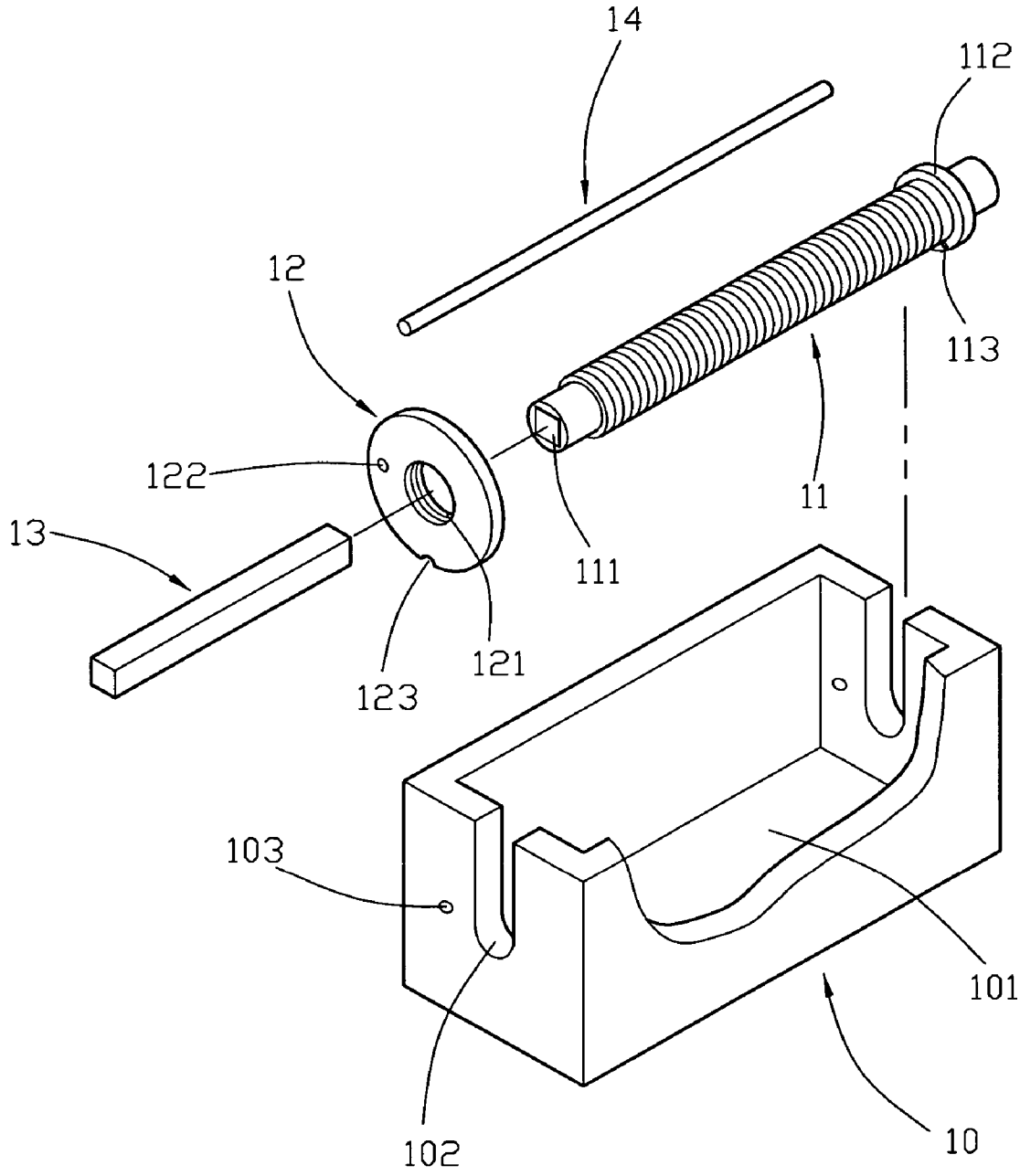
FIG. 8 PRIOR ART
FIG. 8 is an exploded perspective view of a conventional winding mechanism in accordance with the prior art.
Figure 9:
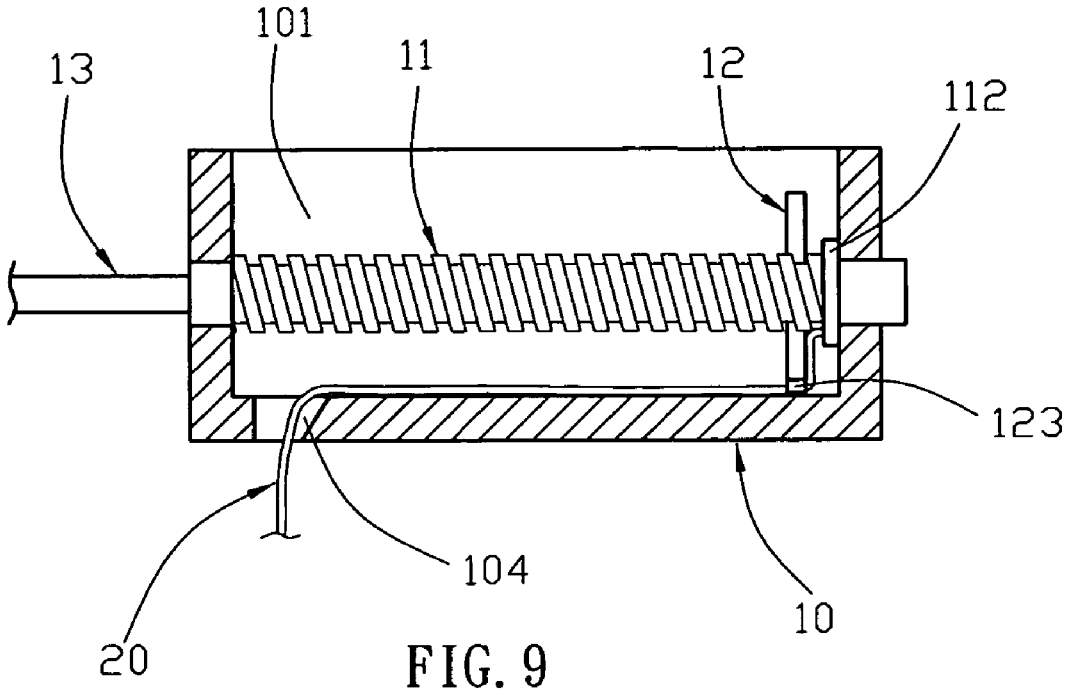
FIG. 9 PRIOR ART
FIG. 9 is a plan cross-sectional assembly view of the conventional winding mechanism as shown in FIG. 8.
Figure 10:
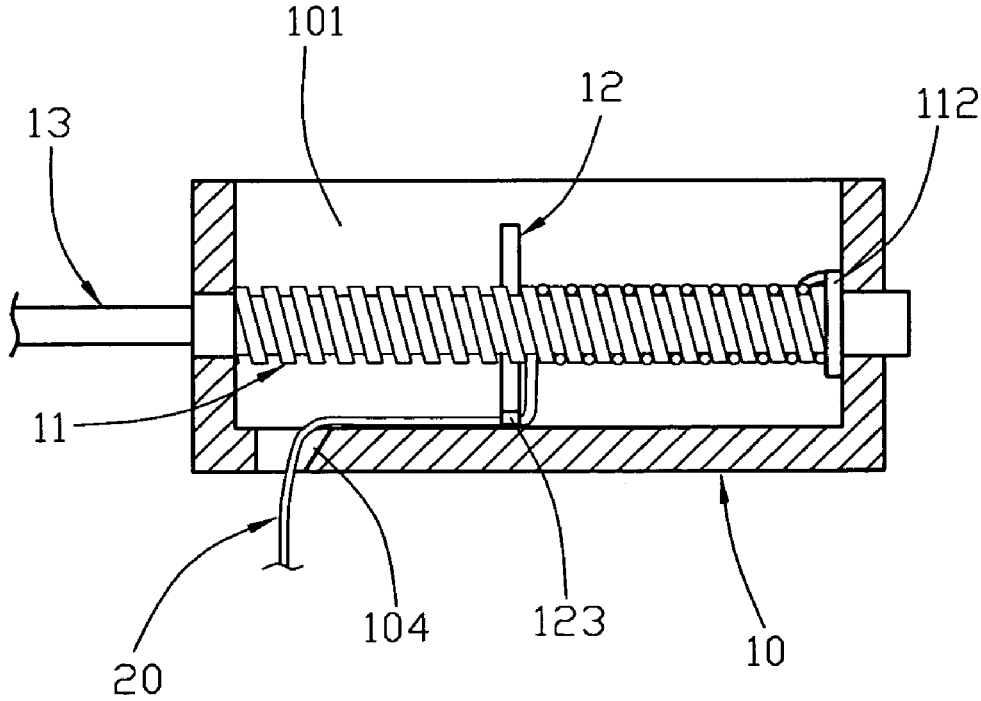
FIG. 10 PRIOR ART
FIG. 10 is a schematic operational view of the conventional winding mechanism as shown in FIG. 9.

As shown in FIG. 7, the resting portion 53 of the first end cap 50 has a side provided with a protruding elastic plate 90 directed toward the guide seat 40, and the resting portion 63 of the second end cap 60 has a side provided with a protruding elastic plate 92 directed toward the guide seat 40. Thus, when the guide seat 40 is movable to rest on the first end cap 50, the guide seat 40 is stopped by the elastic plate 90 of the first end cap 50 to stop a further movement of the guide seat 40, thereby preventing the guide seat 40 from being jammed due to an excessive force applied on the guide seat 40. Alternatively, when the guide seat 40 is movable to rest on the second end cap 60, the guide seat 40 is stopped by the elastic plate 92 of the second end cap 60 to stop a further movement of the guide seat 40, thereby preventing the guide seat 40 from being jammed due to an excessive force applied on the guide seat 40.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A winding mechanism, comprising:

a base having a bottom plate formed with two axially extending slideways;

a rotation member rotatably mounted on the base and having an outer wall formed with an axially extending threaded guide portion;

a guide seat having an inner wall formed with a threaded guide hole screwed onto the threaded guide portion of the rotation member and an outer wall formed with two protruding guide posts each provided with at least one roller slidably mounted in a respective slideway of the base so that the guide seat is axially movable on the rotation member by guidance of the guide posts when the rotation member is rotatable relative to the base;

wherein the rotation member rotates relative to the base and the guide seat translates axially along said rotation member;

each of the guide posts protrudes radially and outwardly from the outer wall of the guide seat;

the two guide posts of the guide seat moving parallel to the slideways of the base respectively, said slideways guiding the movement of the guide seat axially along the rotation member;

the roller of each of the guide posts is in sliding contact with the respective slideway of the base, said two guide posts guided by said roller while moving parallel to the slideways of the base.

2. The winding mechanism in accordance with claim 1, further comprising:

a first end cap secured to a first end of the rotation member to rotate the rotation member and rotatably mounted on a first end of the base;

a second end cap secured to a second end of the rotation member to rotate the rotation member and rotatably mounted on a second end of the base.

3. The winding mechanism in accordance with claim 2, wherein the guide seat is movable between the first end cap and the second end cap and movable to abut the first end cap or the second end cap.

4. The winding mechanism in accordance with claim 2, wherein the first end of the base has a wall formed with an insertion hole, and the first end cap is located in the first end of the base and has a first end formed with a mounting portion inserted into and rotatably mounted in the insertion hole of the base and a second end formed with an enlarged resting portion mounted on the first end of the rotation member and abutting the first end of the base.

5. The winding mechanism in accordance with claim 4, wherein the resting portion of the first end cap has a first side abutting the first end of the base and has a second side formed with a protruding locking portion having a serrated shape and directed toward the guide seat.

6. The winding mechanism in accordance with claim 2, wherein the second end of the base has a wall formed with a recess, and the second end cap is located in the second end of the base and has a first end formed with a mounting portion snapped into and rotatably mounted in the recess of the base and a second end formed with an enlarged resting portion mounted on the second end of the rotation member and abutting the second end of the base.

7. The winding mechanism in accordance with claim 6, wherein the resting portion of the second end cap has a first side abutting the second end of the base and has a second side formed with a protruding locking portion having a serrated shape and directed toward the guide seat.

8. The winding mechanism in accordance with claim 6, wherein the resting portion of the second end cap has an inner wall provided with a plurality of elastic pressing plates rested in the second end of the rotation member, and the second end of the rotation member is pressed between the elastic pressing plates and the resting portion of the second end cap.

9. The winding mechanism in accordance with claim 6, wherein the recess of the base has an opened upper portion formed with two inwardly extending flexible limit edges and a lower portion formed with a substantially arc-shaped support portion, and the mounting portion of the second end cap has a size flush with that of the recess of the base and is supported by the support portion of the base and limited by the limit edges of the base to prevent the second end cap from being moved upwardly to detach from the recess of the base.

10. The winding mechanism in accordance with claim 2, wherein the guide seat has a first side formed with a protruding first catch portion having a serrated shape and directed toward the first end cap and a second side formed with a protruding second catch portion having a serrated shape and directed toward the second end cap.

11. The winding mechanism in accordance with claim 2, further comprising a lift cord secured to the rotation member to rotate with the rotation member and guided by the guide seat, wherein the lift cord passes and is guided by the roller of one of the guide posts of the guide seat.

12. The winding mechanism in accordance with claim 11, wherein the first end of the rotation member has a peripheral wall formed with an axially extending slit to secure the lift cord, the bottom plate of the base has an end formed with a cord passage located in the second end of the base to allow passage of the lift cord, the roller of each of the guide posts of the guide seat has a middle portion formed with an arcuate guide groove to receive and guide the lift cord and a distal end slidable in the respective slideway of the base, and the lift cord is limited between the roller of one of the guide posts of the guide seat and the respective slideway of the base and has a first end secured in the slit of the rotation member and a second end extended through and guided by the guide groove of the roller of one of the guide posts of the guide seat and the cord passage of the base and protruded outwardly from the base.

13. The winding mechanism in accordance with claim 12, wherein the first end cap has an inner wall mounted on the first end of the rotation member and formed with a radially and inwardly extending positioning block inserted into the slit of the rotation member and rested on the lift cord to secure the lift cord in the slit of the rotation member, and the lift cord is clamped between the positioning block of the first end cap and the slit of the rotation member.

14. The winding mechanism in accordance with claim 2, wherein the first end cap has an inside formed with a polygonal drive hole, the second end cap has an inside formed with a polygonal drive bore, and the winding mechanism further comprises a drive shaft having a polygonal shape and extended through the drive hole of the first end cap, the rotation member and the drive bore of the second end cap so that the drive hole of the first end cap and the drive bore of the second end cap are driven by the drive shaft, and the first end cap, the rotation member and the second end cap are rotated simultaneously by the drive shaft.

15. The winding mechanism in accordance with claim 11, wherein each of the guide posts of the guide seat is provided with two juxtaposed rollers, wherein a lower one of the rollers of each of the guide posts is slidable and limited in the respective slideway of the base, and an upper one of the rollers of each of the guide posts protrudes outwardly from the respective slideway of the base and has a middle portion formed with an arcuate guide groove to receive and guide the lift cord.

16. The winding mechanism in accordance with claim 4, wherein the resting portion of the first end cap has a first side abutting the first end of the base and has a second side provided with a protruding elastic plate directed toward the guide seat so that when the guide seat is movable to rest on the elastic plate of the first end cap, the guide seat is spaced from the first end cap and stopped by the elastic plate of the first end cap to stop a further movement of the guide seat relative to the first end cap.

17. The winding mechanism in accordance with claim 6, wherein the resting portion of the second end cap has a first side abutting the second end of the base and has a second side provided with a protruding elastic plate directed toward the guide seat so that when the guide seat is movable to rest on the elastic plate of the second end cap, the guide seat is spaced from the first end cap and stopped by the elastic plate of the second end cap to stop a further movement of the guide seat relative to the second end cap.

18. The winding mechanism in accordance with claim 2, wherein the base has a hollow inside formed with a receiving chamber connected to the slideways to receive the rotation member, the guide seat, the first end cap and the second end cap and has two axially extending opened sidewalls each connected to the receiving chamber.

19. The winding mechanism in accordance with claim 14, wherein the rotation member has a tubular shape and has an inner wall spaced from the drive shaft.

20. The winding mechanism in accordance with claim 1, wherein the guide seat has a ring shape, and the two guide posts of the guide seat are located at the same height.

* * * * *